US011622658B1

(12) United States Patent
Rodriguez

(10) Patent No.: US 11,622,658 B1
(45) Date of Patent: Apr. 11, 2023

(54) TELESCOPING TOILET SYSTEM

(71) Applicant: Olga Rodriguez, Palm Coast, FL (US)

(72) Inventor: Olga Rodriguez, Palm Coast, FL (US)

( * ) Notice: Subject to any disclaimer, the term of this patent is extended or adjusted under 35 U.S.C. 154(b) by 0 days.

(21) Appl. No.: 17/384,194

(22) Filed: Jul. 23, 2021

Related U.S. Application Data

(60) Provisional application No. 63/058,011, filed on Jul. 29, 2020.

(51) Int. Cl.
*A47K 13/08* (2006.01)

(52) U.S. Cl.
CPC ..... *A47K 13/08* (2013.01)

(58) Field of Classification Search
CPC ..... A47K 13/08; A47K 11/04
USPC ..... 4/300.3
See application file for complete search history.

(56) References Cited

U.S. PATENT DOCUMENTS 4,060,859 A * 12/1977 Anderson ..... E03D 11/025 4/300
4,063,316 A 12/1977 Hünninghaus
4,091,473 A 5/1978 Matthews et al.
4,168,552 A * 9/1979 Austin ..... A61G 7/1019 4/667
4,441,218 A 4/1984 Trybom
4,726,079 A 2/1988 Signori et al.
5,063,617 A 11/1991 Ward et al.
5,199,113 A 4/1993 Glasow et al.
5,276,925 A * 1/1994 Blaha ..... E03D 11/025 4/300.3
5,307,524 A 5/1994 Veal
5,465,431 A * 11/1995 Wertz ..... E03D 9/00 4/300.3
6,360,382 B1 3/2002 Karash
6,496,989 B1 12/2002 Meiser
6,553,582 B1 4/2003 Clark
6,978,491 B1 * 12/2005 Miller ..... E03D 9/00 4/300.3
7,496,974 B1 3/2009 Kang
8,196,233 B1 6/2012 Daniels
8,336,130 B1 12/2012 Cardenas
(Continued)

FOREIGN PATENT DOCUMENTS

DE 202007011892 11/2007
KR 20160098726 8/2016
(Continued)

*Primary Examiner* — Christine J Skubinna
(74) *Attorney, Agent, or Firm* — The Patent Professor; H. John Rizvi

(57) ABSTRACT

A telescoping toilet system includes a toilet assembly having a toilet bowl and a toilet tank disposed in fluid communication therewith. A telescoping tube assembly has a telescoping tube mounted to a portion of the toilet bowl which is disposable between a retracted orientation and at least one extended orientation. While disposed in an extended orientation, the telescoping tube minimizes spraying and splashing of urine and/or water onto surrounding surfaces while a user is urinating therein. The telescoping toilet system also includes a tube casing assembly dimensioned to receive the telescoping tube assembly therein while the telescoping tube is disposed in a retracted orientation; and a tube actuator assembly is provided and is operable to dispose the telescoping tube between a retracted orientation and at least one extended orientation.

15 Claims, 7 Drawing Sheets

(56) References Cited

U.S. PATENT DOCUMENTS

| | | | |
|---|---|---|---|
| 8,707,473 | B2 | 4/2014 | Rane |
| 8,800,074 | B2 | 8/2014 | Rodgers et al. |
| 8,978,172 | B2 | 3/2015 | Plate et al. |
| 9,278,037 | B1 | 3/2016 | Primus |
| 10,119,262 | B2 | 11/2018 | Prior |
| 2010/0050328 | A1 | 3/2010 | Hennington |
| 2013/0212795 | A1 | 8/2013 | Mastrogregori |
| 2015/0257956 | A1 | 9/2015 | Wang |

FOREIGN PATENT DOCUMENTS

| | | |
|---|---|---|
| WO | 2002042572 | 5/2002 |
| WO | 2018085939 | 5/2018 |
| WO | 2019213424 | 11/2019 |

* cited by examiner

TELESCOPING TOILET SYSTEM

CROSS-REFERENCE TO RELATED APPLICATIONS

This application claims the benefit of U.S. Provisional Patent Application Ser. No. 63/058,011 filed on Jul. 29, 2020, which is incorporated by reference herein in its entirety.

FIELD OF THE INVENTION

The present invention relates generally to telescoping toilet system having a telescoping tube assembly with a telescoping tube which is disposable between a retracted orientation and at least one extended orientation wherein the telescoping tube extends upwardly from a toilet bowl, so as to minimize spraying and splashing of urine and/or water onto surrounding surfaces while a user is urinating therein.

BACKGROUND OF THE INVENTION

Anyone who has ever lived in a household having both men and women, boys and girls, or combinations thereof, knows full well that a shared bathroom can be a point of contention and the cause of many arguments between members of a family or even the closest of friends. Of course, there are the all too familiar clichés of women and/or girls spending extensive periods of time in the bathroom preparing their hair and/or makeup and/or clothing prior to leaving the house, as well as those of boys and/or men failing to either raise or lower the toilet seat before or after they urinate, respectively.

It is a fact that boys and men typically stand in front of the toilet bowl while urinating. It is also a fact that some boys and men simply do not bother to raise a toilet seat prior to doing so, and even if they do, many times, they forget or, again, simply do not bother to lower the seat once they are finished. Regardless of whether a toilet seat is raised or lowered, it is also a fact that almost every boy or man from time to time will miss the toilet bowl while urinating and/or will urinate so heavily as a cause water and/or urine to splash out of the toilet bowl and onto the surrounding area, such as, the floor, carpet, cabinets, etc. Having urine and/or toilet water spraying and/or splashing onto the surroundings is not only unsightly, it is unsanitary, and have not promptly cleaned will likely result in undesirable orders emanating from the affected surroundings.

Given the fact that a majority of boys and men stand while urinating, most public restrooms provide at least one urinal for boys and men to use while urinating. Typically, the basin of the urinal is elevated much higher above the ground than a standard toilet bowl, and has at least partially enclosed side walls so as to minimize the amount of splash or overspray onto the surrounding surfaces which may occur while a user is urinating therein. It is also fairly common for at least one smaller sized urinal to be placed at a lower elevation for use by smaller boys, once again, so as to minimize the amount of splash or overspray onto the surrounding surfaces while a smaller boy is urinating therein. Thus, providing an elevated at least partially surrounded urinal for boys and men to urinate into while standing results in considerably less splash or overspray of urine and/or urinal water onto the surrounding surfaces while user is urinating therein. However, due to the increased cost, space considerations, as well as the unaesthetic and often unappealing appearance of urinals, they are not typically installed in residential bathrooms.

A number of devices have been contemplated for use with a standard toilet such as may be found in residential bathroom, however, none of these known devices prove effective for resolving present problem of splashing and/or overspray of urine and/or toilet water while user is standing before a toilet bowl and urinating therein.

One such device was contemplated to selectively raise the entire toilet including the base, the bowl and the seat to various elevations above a floor surface and has switches installed to accommodate a variety of user needs such as height, weight, and/or infirmity. It will be appreciated that such a device would be extremely bulky, as well as expensive to install and maintain in a residential bathroom environment.

A similar device was contemplated for an adjustable height toilet having electric actuation means installed near the base of the toilet. As before, it would be appreciated that such a device would be expensive to install and maintain in a residential bathroom environment.

At least one of the foregoing devices further contemplated a sensor to detect a particular user, and to adjust the height of a toilet accordingly for use thereby. Further contemplated were automatic height readjustment and/or automatic flushing after use.

Still another device contemplates a height adjustable toilet seat. More in particular, the device has been contemplated wherein only the toilet seat itself is raised or lowered, once again, so as to accommodate a variety of user needs such as height, weight, and/or infirmity. Such a device further contemplates a wall extending downwardly from the adjustable toilet seat over at least a portion of the underlying toilet bowl. It will be appreciated, however, that such a device fails to address the issue of splashing and/or overspray of urine and/or toilet water while user is standing before the toilet bowl and urinating therein.

Accordingly, there is an established need for a resolution to the problem of a person urinating while standing at a toilet without splashing or spraying urine and/or water onto the surrounding surfaces, such as, by way of example, the floors, carpets, cabinets, etc.

SUMMARY OF THE INVENTION

The present invention is directed to a telescoping toilet system including a telescoping tube assembly having a telescoping tube which is disposable between a retracted orientation and at least one extended orientation wherein the telescoping tube extends upwardly from a toilet bowl, so as to minimize spraying and splashing onto the surrounding surfaces while a user is urinating therein.

In a first implementation of the invention, a telescoping toilet system comprises: a toilet assembly having a toilet bowl and a toilet tank disposed in fluid communication therewith; a telescoping tube assembly comprising a telescoping tube disposable between a retracted orientation and at least one extended orientation, wherein while disposed in at least one extended orientation the telescoping tube reduces the distance through which a user must urinate so as to minimize splashing and/or spraying of urine onto surrounding surfaces; a tube casing assembly dimensioned to receive the telescoping tube assembly therein while the telescoping tube is disposed in the retracted orientation; and a tube actuator assembly operable to dispose the telescoping tube between the retracted orientation and the at least one extended orientation.

In a second aspect, the telescoping toilet system can include a telescoping tube having an upper end and a lower end, and further, a sidewall extending therearound between the upper end and the lower end.

In another aspect, the telescoping toilet system may have a telescoping tube with a sidewall having a brim disposed at least partially along an upper end, wherein the brim comprises a bowl seat along an underside thereof.

In one other aspect, the telescoping toilet system can include a tube casing assembly comprises a tube channel disposed between an inner bowl and an outer bowl of a toilet bowl, wherein the tube channel is dimensioned and configured to receive a telescoping tube therein while the telescoping tube is disposed in a retracted orientation.

In still another aspect, the telescoping toilet system may have a tube casing assembly comprising a tube seat which receives a bowl seat of a telescoping tube therein while the telescoping tube is disposed in a retracted orientation.

In a further aspect, the telescoping toilet system can include a telescoping tube having at least one deflector attached along an inner surface of a sidewall thereof, the deflector extending outwardly from an inner surface of the sidewall into an at least partially covering relation to a tube casing assembly to prevent passage of fluid into a tube channel.

In yet one other aspect, the telescoping toilet system may have a tube actuator assembly comprising a tube actuator having a tube interconnect disposed in an operative engagement with at least a portion of a telescoping tube.

In still one further aspect, the telescoping toilet system can include a tube actuator operable to raise a telescoping tube from a retracted orientation to at least one extended orientation, and to lower the telescoping tube from at least one extended orientation into a retracted orientation.

In yet another aspect, the telescoping toilet system may have a control assembly including a control pad, the control pad having one or more of a power control, a direction control and/or one or more presets, wherein each preset is operable to cause a tube actuator to dispose a telescoping tube into one of a plurality of preselected extended orientations.

In another further aspect, the telescoping toilet system can include a tube actuator assembly further having an actuation sensor disposed in communication with a control assembly, wherein the actuation sensor operable to detect whether a toilet seat is disposed in an open configuration or closed configuration, and wherein the control assembly prevents operation of the tube actuator while the actuation sensor detects the toilet seat disposed in a closed configuration.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left". "rear". "right". "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a telescoping toilet system including a telescoping tube assembly having a telescoping tube which is disposable between a retracted orientation and at least one extended orientation wherein the telescoping tube extends upwardly from a toilet bowl, so as to minimize spraying and splashing onto the surrounding surfaces while a user is urinating therein.

Figure 1:
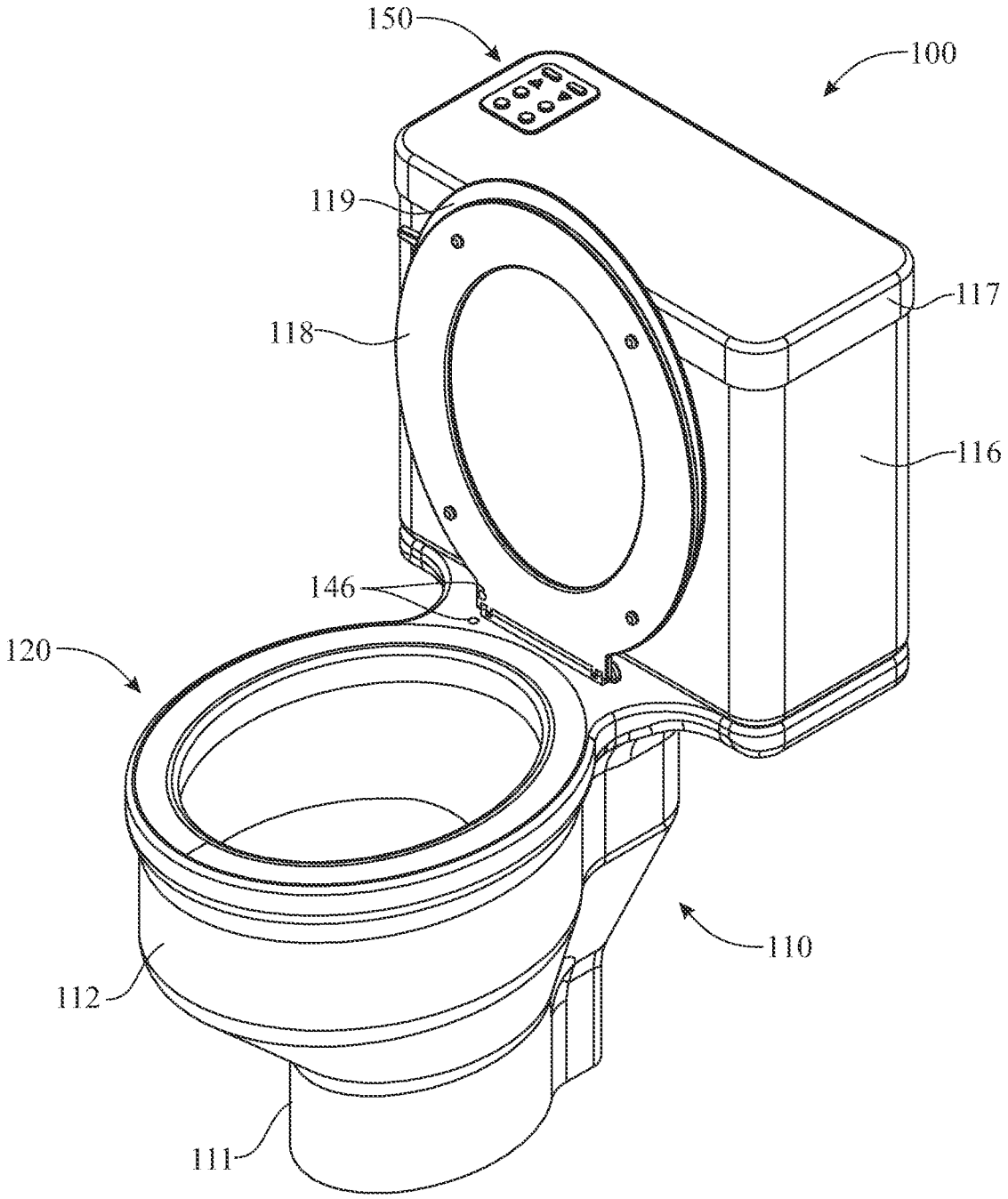
FIG. 1 presents a perspective view of one illustrative embodiment of a telescoping toilet system, in accordance with the present invention.
Figure 2:
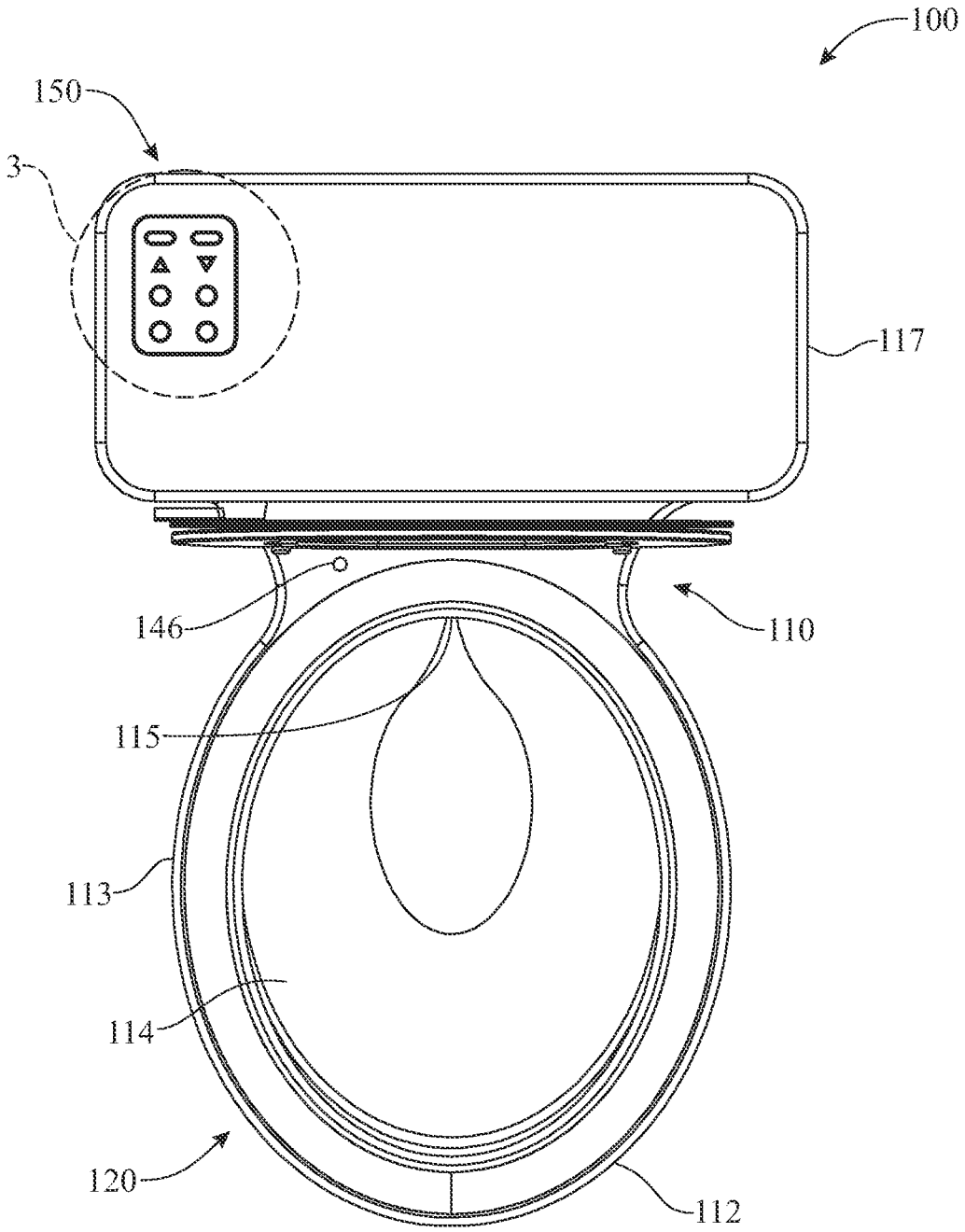
FIG. 2 presents a top plan view of the embodiment of the telescoping toilet system of FIG. 1, in accordance with the present invention.

Referring initially to FIGS. 1 and 2, perspective and top plan views, respectively, of one illustrative embodiment of a telescoping toilet system, generally as shown as at 100 throughout the figures, are presented. As shown throughout the figures, a telescoping toilet system 100 in accordance with the present invention comprises a toilet assembly 110 and a telescoping tube assembly 120 cooperatively configured therewith. As may be seen from FIGS. 1 and 2, in at least one embodiment a telescoping toilet system 100 further comprises a control assembly 150.

A toilet assembly 110 includes a base 111 having a toilet bowl 112 mounted on or attached thereto. As may be seen best from FIG. 2, a toilet assembly 110 further comprises a drain 115 disposed through a lower portion of the toilet bowl 112. As will be appreciated, the drain 115 is configured to connect to a drain pipe in a facility in which a telescoping toilet system 100 is installed. It is further to be appreciated that waste accumulating in a toilet bowl 112 of a toilet assembly 110 in accordance with the present invention may be flushed out through the drain 115 into the drain pipe which transfers the waste to a septic system or to a trunk line of a sewage collection system.

The toilet assembly 110 in accordance with at least one embodiment of the present invention further comprises a toilet tank 116 disposed in fluid communication with at least a portion of the toilet bowl 112. In such an embodiment, the toilet tank 116 is typically mounted above and to the rear of the toilet bowl 112. In such an arrangement, after use, the user may flush the toilet assembly 110 thereby releasing water stored in the toilet tank 116 into the toilet bowl 112 so as to flush the waste accumulated therein through the drain 115 and into the drain pipe, such as described above. With reference again to FIGS. 1 and 2, in at least one embodiment the toilet assembly 112 in accordance with the present invention further comprises a lid 117 such as is typically employee to cover an open upper portion of a toilet tank 116. As will be appreciated by those of skill in the art, in at least one embodiment of the present telescoping toilet system 100, a toilet bowl 112 of a toilet assembly 110 may be connected directly to a pressurized water supply line which is temporarily opened to allow water to flow into a toilet bowl 112 so as to flush out waste accumulated therein through drain 115, without the need for a toilet tank 116.

One embodiment of the present telescoping toilet system 100 comprises a control assembly 150, described in greater detail hereinafter, and in at least one further embodiment, a telescoping toilet system 100 comprises a control assembly 150 mounted to a lid 117 of a toilet assembly 110, as shown in FIGS. 1 and 2. A toilet assembly 110 in accordance with at least one embodiment of the present invention further comprises a seat 118 which is movable relative to a toilet bowl 112 and is disposable between an open and a closed configuration relative thereto. In yet one further embodiment, a toilet assembly 110 in accordance with the present invention also includes a cover 119 which is disposable between an open and a closed configuration relative to a seat 118.

A toilet assembly 110, and/or the primary components thereof, including but not limited to the base 111, toilet bowl 112, the toilet tank 116 and/or the lid 117, may be constructed from any of a variety of strong rigid materials including porcelain, concrete, plastics, engineered plastics, etc. Further, a toilet assembly 110 may be provided in any of a number of decorative colors such as are typically provided for bathroom appliances.

Figure 4:
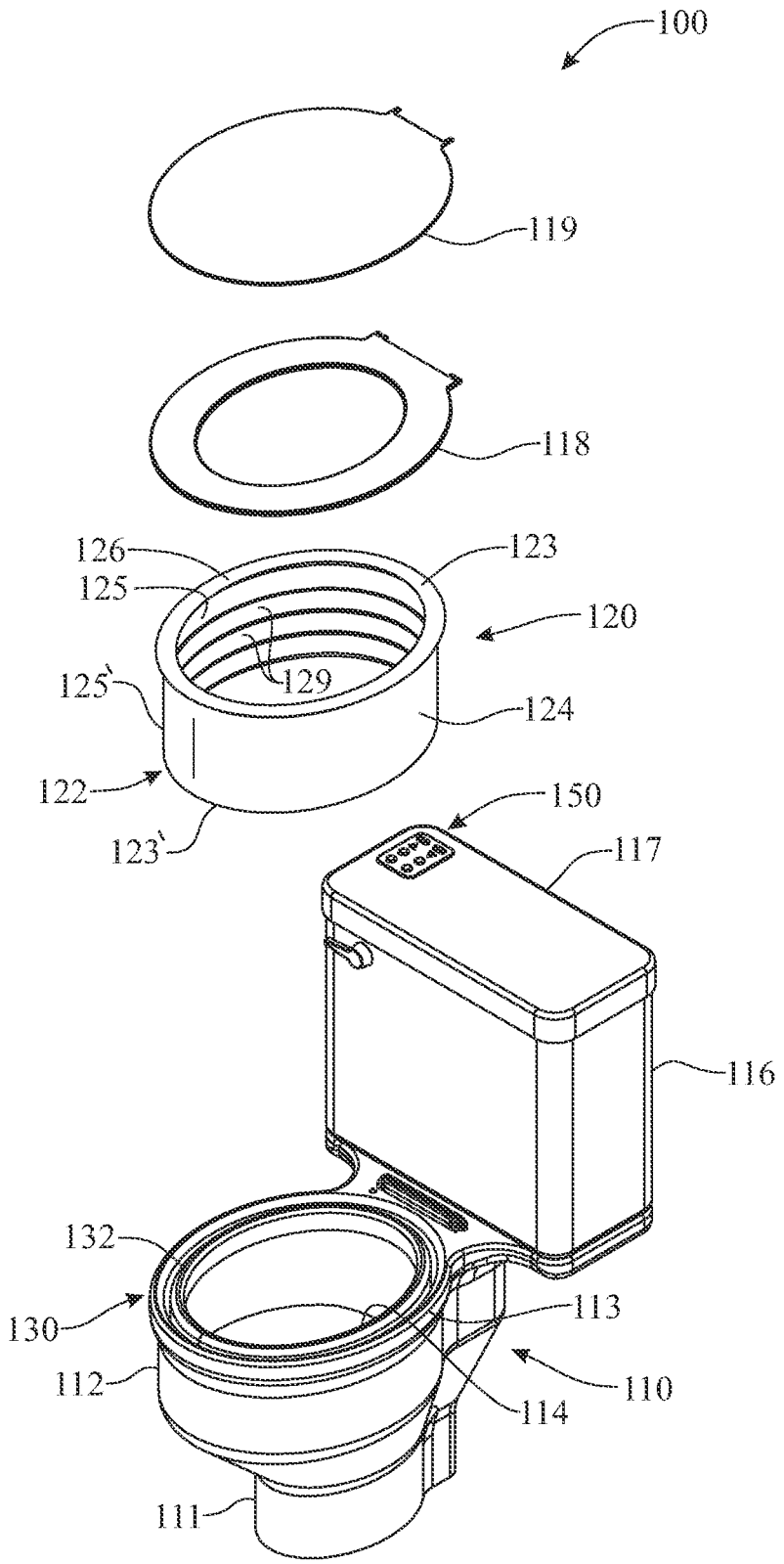
FIG. 4 presents a partially exploded perspective view of one illustrative embodiment of a telescoping toilet system, in accordance with the present invention.

Turning next to FIG. 4, a partially exploded perspective view of one illustrative embodiment of a telescoping toilet system 100 in accordance with the present invention is presented therein. As before, a telescoping toilet system 100 comprises a toilet assembly 110 having a toilet bowl 112 mounted to a base 111. Also as before, the toilet assembly 110 includes a toilet tank 116 mounted above and behind the toilet bowl 112, and a lid 117 covering the upper open end of the toilet tank 116. FIG. 4 is illustrative of at least one embodiment of the toilet bowl 112 comprising an outer bowl 113 and an inner bowl 114. A seat 118 and a corresponding lid 119 are also shown in the illustrative embodiment of FIG. 4.

With continued reference to FIG. 4, a telescoping toilet system 100 in accordance with at least one embodiment of the present invention further comprises a telescoping tube assembly 120. As shown in the illustrative embodiment of FIG. 4, a telescoping tube assembly 120 comprises a telescoping tube 122. A telescoping tube 122 has an upper end 123 and a lower end 123'. In at least one embodiment, a telescoping tube 122 further includes a sidewall 124 extending therearound between the upper end 123 and the lower end 123'. A sidewall 124 of a telescoping tube 122 further comprises and is at least partially defined by an inner surface 125 and an outer surface 125'. In at least one embodiment, a telescoping tube 122 comprises at least one deflector 129 attached along an inner surface 125 of a sidewall 124 thereof. In one further embodiment, the at least one deflector 129 comprises a flexible construction. More in particular, in one embodiment, at least one deflector 129 is flexibly disposable between an outwardly extending and at least partially covering relation to at least a portion of a tube casing assembly 130 to prevent passage of fluid into a tube channel 132 thereof, discussed in greater detail hereinafter, or in a collapsed stored configuration in the tube channel 132, once again, as discussed in greater detail below. In one embodiment, a telescoping tube 122 comprises a plurality of deflectors 129 arranged and attached along an inner surface 125 of a sidewall 124 thereof, such as is shown, by way of example, in FIG. 4.

Figure 7:
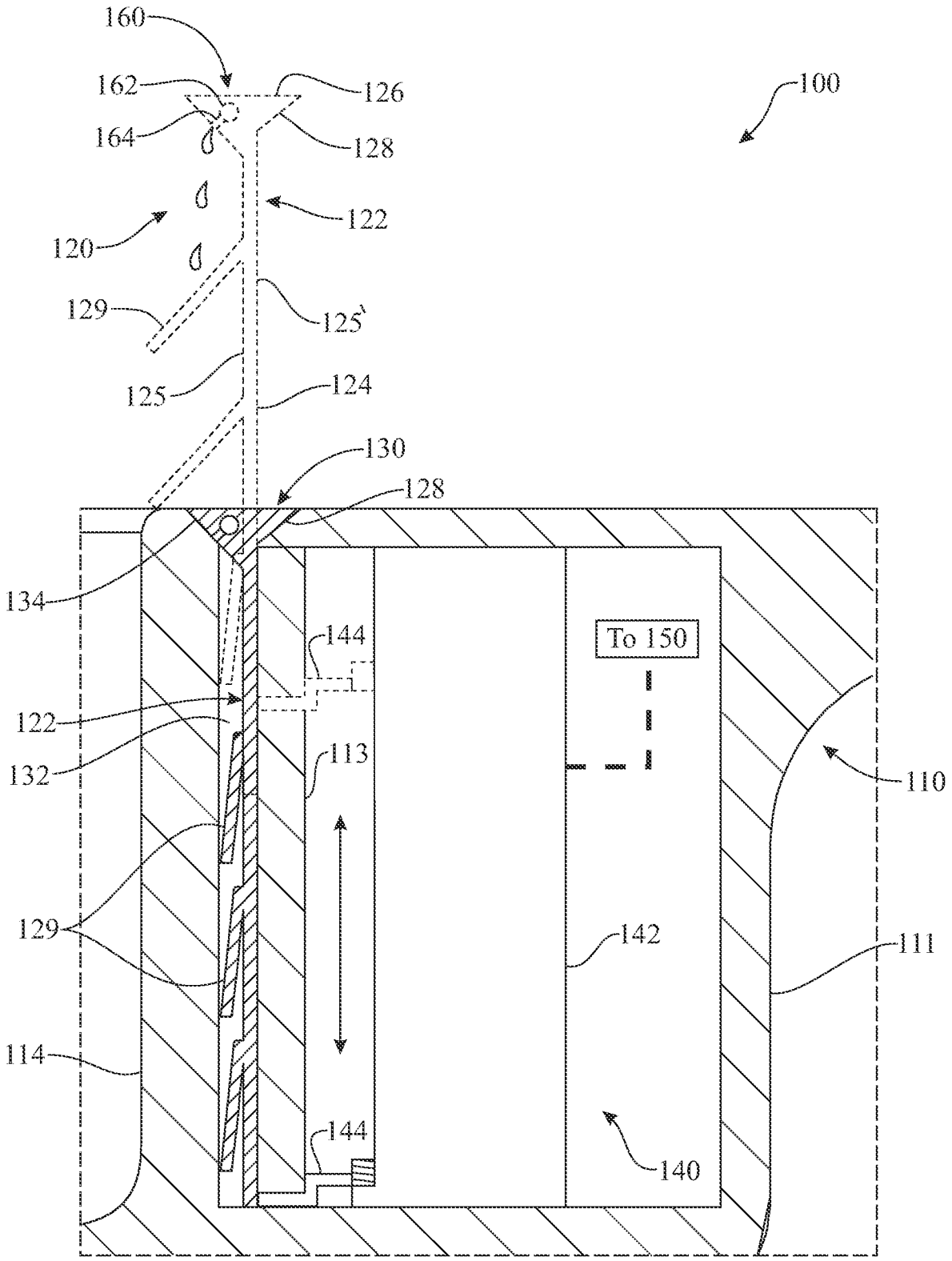
FIG. 7 presents a partial cutaway view of a portion of one illustrative embodiment of a telescoping toilet system, in accordance with the present invention.

In yet one further embodiment of the present invention, a telescoping tube 122 of a telescoping tube assembly 120 comprises a brim 126 disposed along and around at least a portion of an upper end 123 of the sidewall 124, such as is shown in the illustrative embodiment of FIG. 4. A brim 126 of a telescoping tube 122 in accordance with at least one embodiment of the present invention comprises a bowl seat 128 disposed along and around an underside thereof. As may be seen from the illustrative embodiment of FIG. 7, a bowl seat 128 of a telescoping tube assembly 120 in at least one embodiment comprises a generally V-shaped configuration.

As shown throughout the figures, a telescoping tube 122 comprises a generally cylindrical configuration. However, it will be appreciated that a telescoping tube 122 in accordance with the present telescoping toilet system 100 may comprise other geometric configurations such as may be warranted to correspond to different geometric configurations of a corresponding toilet bowl 112. As one example, a toilet bowl 112 having an elongated configuration may be utilized in the present invention in which case, a telescoping tube 122 may be configured to comprise a generally oval configuration so as to correspond to the generally oval configuration of an elongated toilet bowl 112. Alternatively, a telescoping tube 122 may comprise a generally square, or rectangular, or triangular configuration, such may be warranted to correspond to a generally square, or rectangular, or triangular configuration of a toilet bowl 112.

A telescoping tube assembly 120 in accordance with the present invention, including but not limited to a telescoping tube 122, may be constructed from any of a variety of materials including rigid and/or semi rigid materials of construction such as metals, metal alloys, ceramics, plastics, engineering plastics, etc.

With reference once again to the illustrative embodiment of FIG. 4, and as noted above, the present telescoping toilet system 100 further comprises a tube casing assembly 130. A tube casing assembly 130 in accordance with at least one embodiment of the present invention is dimensioned and configured to receive a telescoping tube assembly 120 therein, while a telescoping tube 122 is disposed in a retracted orientation. More in particular, in at least one embodiment, a tube casing assembly 130 comprises a tube channel 132 which is disposed between an outer bowl 113 and an inner bowl 114 of a toilet bowl 112. As may be seen best in FIG. 7, a tube channel 132 is dimensioned and configured to receive a telescoping tube 122 therein while a telescoping tube 122 is disposed in a retracted orientation.

Figure 5:
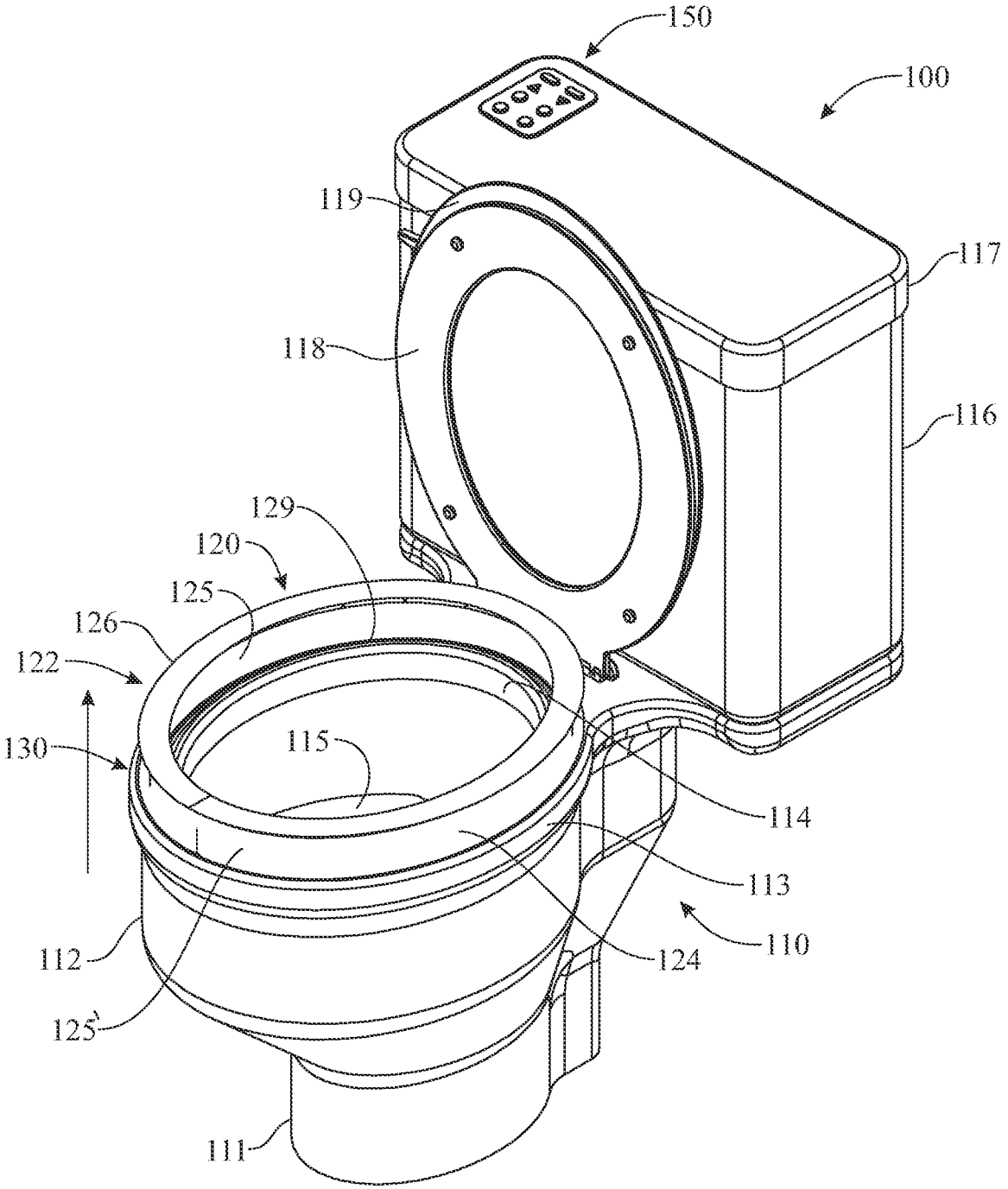
FIG. 5 presents a perspective view of one illustrative embodiment of a telescoping toilet system having a telescoping tube disposed in a first extended orientation, in accordance with the present invention.
Figure 6:
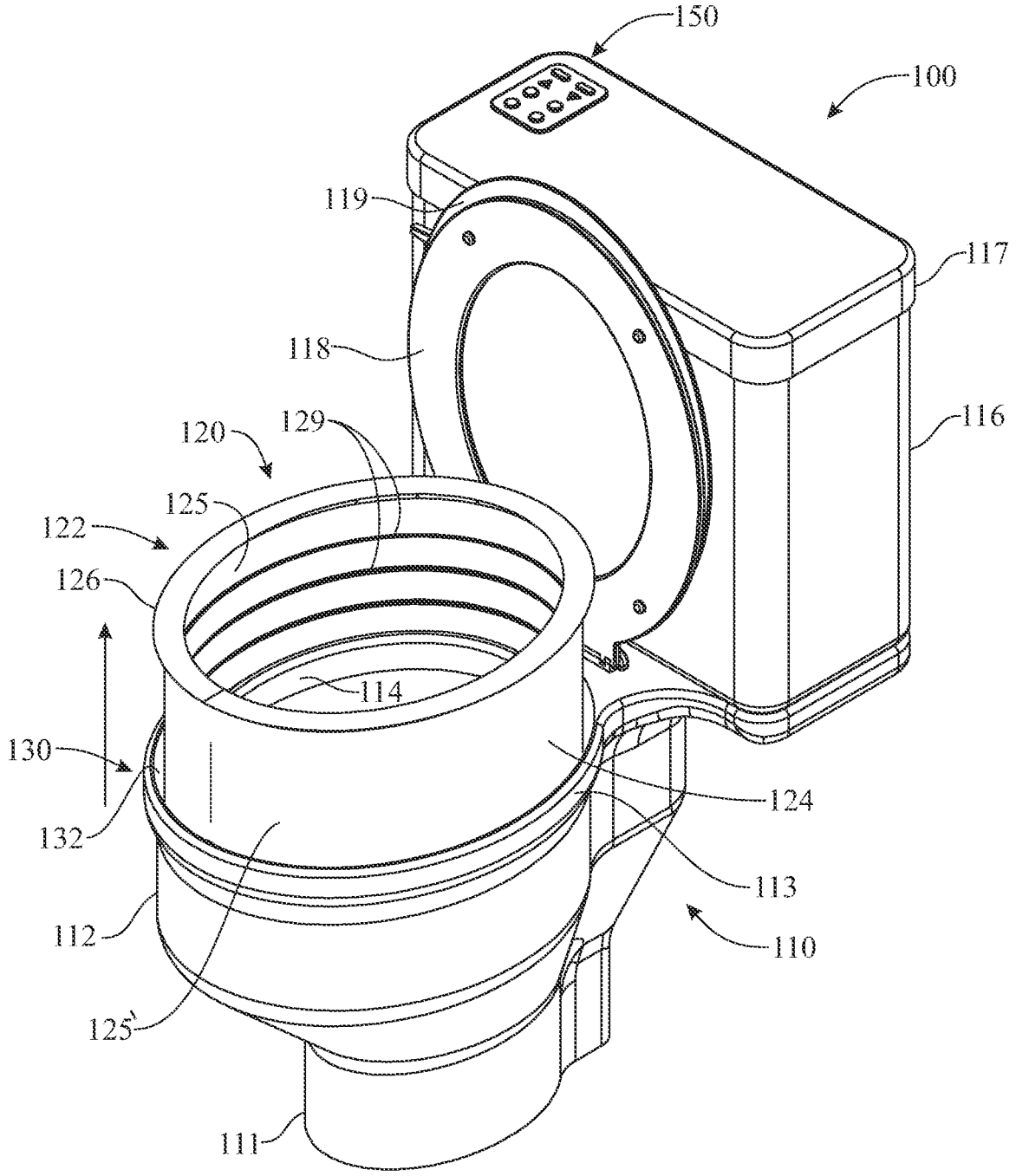
FIG. 6 presents a perspective view of the embodiment of a telescoping toilet system having a telescoping tube of FIG. 5 disposed in a second extended orientation, in accordance with the present invention.

As further shown in the figures, in at least one embodiment, a tube casing assembly 130 further comprises a tube seat 134 disposed along and around an upper portion thereof. As shown best in FIG. 7, the tube seat 134 of the tube casing assembly 130 comprises a generally V-shaped configuration dimensioned to receive the generally V-shaped bowl seat 128 of the telescoping tube 122 therein, while the telescoping tube 122 is disposed in a retracted orientation in the tube channel 132. Further, while the telescoping tube 122 is disposed in an extended orientation, for example, such as is shown by way of example in FIGS. 5 and 6, a deflector 129 attached along the inner surface 125 of the sidewall 124 of the telescoping tube 122 extends outwardly from the inner surface 125 of the sidewall 124 into an at least partially covering relation to the tube seat 134 of the tube casing assembly 130, such as is shown best in FIG. 7. As such, a deflector serves to direct urine and flush water inwardly towards the inner bowl 114 of the toilet bowl 112, and into the drain 115 thereof, so as to prevent urine and/or flush water from entering the tube channel 132 of the tube casing 130.

At least one embodiment of a telescoping toilet system 100 of the present invention further comprises a tube actuator assembly 140. A tube actuator assembly 140 comprises a tube actuator 142 operable to dispose a telescoping tube 122 between a retracted orientation, such as is shown by way of example in FIG. 1, and at least one extended orientation such as is shown by way of example in FIGS. 5 and 6. More in particular, a tube actuator 142 comprises a tube interconnect 144 disposed to operably engage at least a portion of a telescoping tube 122, such as is shown best in FIG. 7, wherein operation of the tube actuator 142 causes the telescoping tube 122 to rise upwardly and outwardly from a tube channel 132 of the tube casing 130 into an extended orientation, once again, such as is shown in the illustrative embodiments of FIGS. 5 and 6. After use and flushing of the present telescoping toilet system 100, the tube actuator 142 is operable to lower the telescoping tube 122 from an extended orientation to a retracted orientation disposed within a tube channel 132 of the tube casing 130, once again, as shown by way of example in the illustrative embodiments of FIGS. 1 and 7.

As previously indicated, at least one embodiment of a telescoping toilet system 100 in accordance with the present invention comprises a control assembly 150. With reference to the illustrative embodiment of FIG. 3, a control assembly 150 comprises a control pad 152. As shown throughout the figures, a control assembly 150 is mounted to a lid 117 of the toilet assembly 110. However, it will be appreciated that a control assembly 150 may be mounted to other portions of the toilet assembly 110 in accordance with the present invention. It will be further appreciated, that a control assembly 150 may be provided in the form of a remote control device, such as our commonly used to operate a variety of household items, including but not limited to televisions, cable systems, entertainment centers, heating and air conditioning systems, lighting, etc.

Figure 3:
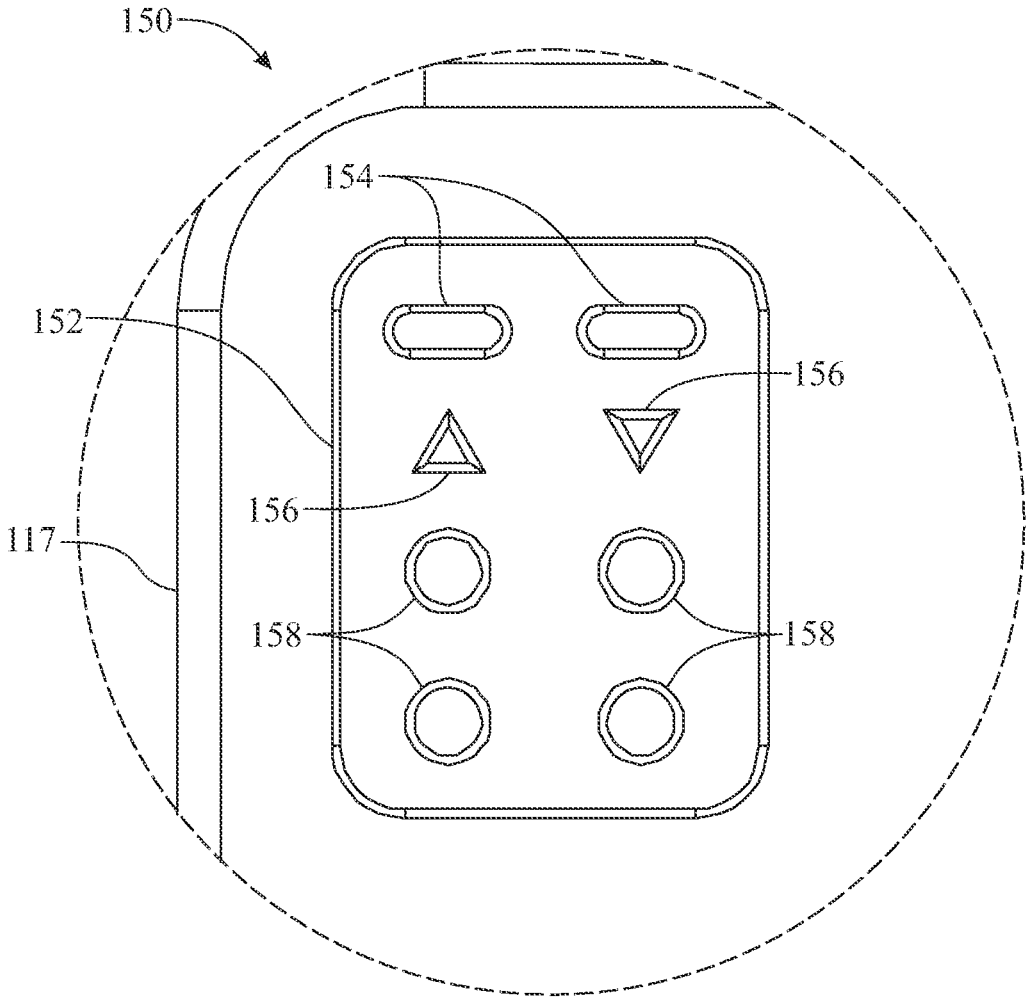
FIG. 3 presents a top plan view of one illustrative embodiment of a control assembly of a telescoping toilet system as shown in Inset 3 of FIG. 2, in accordance with the present invention.

Looking once again to the illustrative embodiment of FIG. 3, a control assembly 150 includes a keypad 152 having a number of buttons or switches operable thereon. For example, in at least one embodiment, a control pad 152 includes one or more power controls 154, operable by a user to activate or deactivate, as the case may be, a tube actuator assembly 140. In one further embodiment, a control pad 152 of the control assembly 150 includes directional controls 156 once again, as may be seen in the illustrative embodiment of FIG. 3. More in particular, directional controls 156 are operable by a user to cause a tube actuator assembly 140 to either raise or lower a telescoping tube 122 of a telescoping tube assembly 120 up from or down into a tube channel 132 of a tube casing assembly 130, respectively.

With continued reference to FIG. 3, in at least one embodiment a control assembly 150 in accordance with the present invention comprises a plurality of presets 158. Each preset 158 may be preprogrammed to cause a tube actuator assembly 142 to raise a telescoping tube 122 to a different one of a plurality of preselected extended orientations. As one example, the plurality of presets 158 may be preprogrammed to cause the tube actuator assembly 142 to raise the telescoping tube 122 into a different one each of the plurality of increasingly greater extended orientations. More in particular, and once again by way of example only: a first preset 158 may be preprogrammed to cause the tube actuator assembly 142 to raise the telescoping tube 122 to an extended height of 3 inches above the top of the toilet bowl 112; a second preset 158 may be preprogrammed to cause the tube actuator assembly 142 to raise the telescoping tube 122 to an extended height of 6 inches above the top of the toilet bowl 112; a third preset 158 may be preprogrammed to cause the tube actuator assembly 142 to raise the telescoping tube 122 to an extended height of 9 inches above the top of the toilet bowl 112; and, a fourth preset 158 may be preprogrammed to cause the tube actuator assembly 142 to raise the telescoping tube 122 to an extended height of 12 inches above the top of the toilet bowl 112. Of course, it is to be appreciated that a plurality of presets 158 may be programmed to cause the tube actuator assembly 142 to raise the telescoping tube 122 to any of a number of extended heights above the top of the toilet bowl 112 such as a user may desire.

Regardless, it is also to be appreciated that a control assembly 150 in accordance with the present telescoping toilet system 100 is utilized to raise a telescoping tube 122 of a telescoping tube assembly 120 to various extended heights above the top of the toilet bowl 112 of the toilet assembly 110 so as to accommodate user's ranging from small children to full grown adults. More in particular, the present telescoping toilet system 100 allows a user to raise a telescoping tube 122 of a telescoping tube assembly 120 to any of a number of extended heights above the top of the toilet bowl 112 of the toilet assembly 110 so as to reduce the distance through which a user must urinate so as to minimize splashing and/or spraying of urine onto surrounding surfaces.

At least one further embodiment of a telescoping toilet system 100 in accordance with the present invention further comprises a tube flush assembly 160. More in particular, a tube flush assembly 160 is provided to direct an amount of flush water over and along the inner surface 125 of the sidewall 124 of a telescoping tube 122 after use, i.e., after a user has urinated therein. In at least one embodiment, a tube flush assembly 160 comprises a tube flush conduit 162 disposed around and along at least a portion of a brim 126 of a telescoping tube 122. With reference once again to FIG. 7, a tube flush conduit 162 is disposed around and through a portion of the bowl seat 128, and as further shown in FIG. 7, the tube flush assembly 160 comprises a plurality of tube flush apertures 164 formed through the tube flush conduit 162 of the bowl seat 128 such that an amount of flush water provided via a supply line (not shown) may be discharged through the plurality of tube flush apertures 164 and onto the inner surface 125 of the sidewall 124 of the telescoping tube 122 after use so as rinse the inner surface 125 of urine or other waste from the inner surface 125 of the sidewall 124 into the drain 115 of the toilet bowl 112.

After use and flushing, the control assembly 150 may be utilized by the user to cause the tube actuator assembly 142 to lower the telescoping tube 122 into a retracted orientation within a tube channel 132 of a tube casing assembly 130, at which point, a seat 118 and/or a cover 119 of the toilet assembly 110 may be lowered into a closed configuration relative to a toilet bowl 112, such that the toilet assembly 110 may be utilized as a regular toilet. In at least one embodiment, after use and flushing, a user simply tilts the seat 118 forward into contact with a portion of the telescoping tube 122, at which point, the actuation sensors 146 disposed in cooperative positions on the toilet bowl 112 and the seat 118 visually connect and transmit a signal to the control assembly 150, thereby causing the tube actuator assembly 142 to lower the telescoping tube 122 into a retracted orientation within a tube channel 132 of a tube casing assembly 130, as the seat 118 is lowered into a closed orientation relative to the toilet bowl 112, once again, allowing the toilet assembly 110 may be utilized as a regular toilet.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A telescoping toilet system for use by a user to urinate therein comprising:

a toilet assembly having a toilet bowl and a toilet tank disposed in fluid communication therewith, said toilet bowl comprises an inner bowl and an outer bowl;

a telescoping tube assembly comprising a telescoping tube disposable between a retracted orientation and at least one extended orientation, wherein while disposed in said at least one extended orientation said telescoping tube reduces the distance through which the user must urinate so as to minimize splashing and/or spraying of urine onto surrounding surfaces;

a tube casing assembly dimensioned to receive said telescoping tube assembly therein while said telescoping tube is disposed in said retracted orientation, said tube casing assembly comprises a tube channel disposed between said inner bowl and said outer bowl of said toilet bowl, wherein said tube channel is dimensioned and configured to receive said telescoping tube therein while said telescoping tube is disposed in said retracted orientation;

said tube casing assembly further comprises a tube seat which receives a bowl seat of said telescoping tube therein while said telescoping tube is disposed in said retracted orientation; and a tube actuator assembly operable to dispose said telescoping tube between said retracted orientation and said at least one extended orientation.

2. The telescoping toilet system as recited in claim 1 wherein said telescoping tube comprises an upper end and a lower end.

3. The telescoping toilet system as recited in claim 2 wherein said telescoping tube comprises a sidewall extending therearound between said upper end and said lower end.

4. The telescoping toilet system as recited in claim 3 wherein said sidewall further comprises a brim disposed at least partially along said upper end.

5. The telescoping toilet system as recited in claim 4 wherein said brim comprises a bowl seat along an underside thereof.

6. The telescoping toilet system as recited in claim 1 wherein said telescoping tube further comprises at least one deflector attached along an inner surface of a sidewall thereof, said deflector extending outwardly from said inner surface of said sidewall into an at least partially covering relation to said tube casing assembly to prevent passage of fluid into said tube channel.

7. The telescoping toilet system as recited in claim 1 wherein said tube actuator assembly comprises a tube actuator having a tube interconnect disposed in an operative engagement with at least a portion of said telescoping tube.

8. The telescoping toilet system as recited in claim 7 wherein said tube actuator is operable to raise said telescoping tube from said retracted orientation into said at least one extended orientation.

9. The telescoping toilet system as recited in claim 7 wherein said tube actuator is operable to lower said telescoping tube from said at least one extended orientation into said retracted orientation.

10. A telescoping toilet system for use by a user to urinate therein comprising:

a toilet assembly comprising a toilet bowl and a toilet tank disposed in fluid communication therewith;

said toilet assembly comprising a toilet seat moveably mounted thereto and disposable between an open configuration and a closed configuration, a telescoping tube assembly having a telescoping tube disposable between a retracted orientation and a plurality of extended orientations;

a tube casing assembly comprising a tube channel disposed between said inner bowl and said outer bowl of said toilet bowl, said tube channel dimensioned to receive said telescoping tube assembly therein while said telescoping tube is disposed in said retracted orientation;

a tube actuator assembly comprising a tube actuator operable to dispose said telescoping tube between said retracted orientation and each of said plurality of extended orientations, wherein said tube actuator assembly further comprises an actuation sensor disposed in communication with said control assembly, said actuation sensor operable to detect whether said toilet seat is disposed in said open configuration or said closed configuration; and a control assembly having a control pad communicative with said tube actuator assembly to facilitate operation thereof.

11. The telescoping toilet system as recited in claim 10 wherein said control assembly prevents operation of said tube actuator while said toilet seat is disposed in said closed configuration.

12. The telescoping toilet system as recited in claim 10 wherein said control pad comprises a power control operable to either activate or deactivate said tube actuator.

13. The telescoping toilet system as recited in claim 10 wherein said control pad has a direction control operable to cause said tube actuator to either raise or lower said telescoping tube.

14. The telescoping toilet system as recited in claim 10 wherein said control pad has a plurality of presets each operable to cause said tube actuator to dispose said telescoping tube into one of a plurality of preselected extended orientations.

15. A telescoping toilet system for use by a user to urinate therein comprising:

a toilet assembly comprising a toilet bowl and a toilet tank disposed in fluid communication therewith, said toilet bowl having a drain formed through a lower portion thereof;

a telescoping tube assembly having a telescoping tube comprising a sidewall extending therearound between an upper end and a lower end thereof, said sidewall having an inner surface and an outer surface;

said telescoping tube disposable between a retracted orientation and a plurality of extended orientations;

a tube casing assembly dimensioned to receive said telescoping tube assembly therein while said telescoping tube is disposed in said retracted orientation;

a tube actuator assembly comprising a tube actuator operable to dispose said telescoping tube between said retracted orientation and each of said plurality of extended orientations;

a control assembly having a control pad communicative with said tube actuator to facilitate operation thereof; and a tube flush assembly having a tube flush conduit disposed at least partially around said upper end of said telescoping tube and a plurality of flush apertures positioned therealong to discharge an amount of a flush fluid therethrough along said inner surface of said sidewall of said telescoping tube and into said toilet bowl.

* * * * *